US012031281B2

(12) United States Patent
Usui et al.

(10) Patent No.: US 12,031,281 B2
(45) Date of Patent: Jul. 9, 2024

(54) VISION GUIDE WITH LIGHT GUIDING ROD AND GUARD CABLE USING SAME

(71) Applicants: FUKUVI CHEMICAL INDUSTRY CO., LTD., Fukui (JP); RIKEN KOGYO INC., Otaru (JP)

(72) Inventors: Yuto Usui, Fukui (JP); Kodai Hatakeyama, Fukui (JP); Tatsuya Yamazaki, Fukui (JP); Yukihiro Shibao, Otaru (JP)

(73) Assignees: FUKUVI CHEMICAL INDUSTRY CO., LTD., Fukui (JP); RIKEN KOGYO INC., Otaru (JP)

( * ) Notice: Subject to any disclaimer, the term of this patent is extended or adjusted under 35 U.S.C. 154(b) by 413 days.

(21) Appl. No.: 17/603,610

(22) PCT Filed: Apr. 15, 2019

(86) PCT No.: PCT/JP2019/016204
§ 371 (c)(1),
(2) Date: Oct. 14, 2021

(87) PCT Pub. No.: WO2020/213041
PCT Pub. Date: Oct. 22, 2020

(65) Prior Publication Data

US 2022/0213657 A1 Jul. 7, 2022

(51) Int. Cl.
*E01F 15/00* (2006.01)
*D07B 1/14* (2006.01)
*E01F 15/06* (2006.01)

(52) U.S. Cl.
CPC ..... *E01F 15/06* (2013.01); *D07B 1/148* (2013.01)

(58) Field of Classification Search
CPC ..... D07B 1/145; D07B 1/147; D07B 1/148; D07B 1/16; D07B 1/068; D07B 7/02; D07B 7/147
See application file for complete search history.

(56) References Cited

U.S. PATENT DOCUMENTS

| | | | | |
|---|---|---|---|---|
| 9,075,022 | B2 * | 7/2015 | Huntley | D07B 1/145 |
| 2004/0022053 | A1 * | 2/2004 | Sharon | H05B 33/00 362/225 |
| 2010/0098948 | A1 * | 4/2010 | Nakanishi | D02G 3/444 428/394 |

FOREIGN PATENT DOCUMENTS

| | | |
|---|---|---|
| JP | S54-41049 Y2 | 12/1979 |
| JP | S60-40519 U | 3/1985 |

* cited by examiner

*Primary Examiner* — Daniel J Wiley
(74) *Attorney, Agent, or Firm* — Oliff PLC

(57) ABSTRACT

A vision guide with a light guiding rod including rope member formed by twisting plural strands; light guiding rod of circumferentially light emitting type being adheringly wound around spiral indentations formed between strands on outer circumference of rope member with core layer made of acrylic-based resin and clad layer made of fluorine-based resin; and light source attached to end portion of light guiding rod, wherein amount of change luminance of light guiding rod in test time over duration of 1000 hours by accelerated weathering tester is contained within range of ±10%; amount of change in each numerical value of chromaticity [x, y] is contained within range of ±0.02; flexural modulus of elasticity of light guiding rod under atmosphere of −20 degrees Centigrade is contained at range of 0.5-5.0× $10^3$ MPa; rope member is formed by twisting strands at twisting angle from 10°-20°; and spiral indentations are uniformly formed with pitch from 100 mm-200 mm.

8 Claims, 4 Drawing Sheets

(a)

(b)

<Cross-sectional view along X—X' >

(a)

(b)

<Enlarged Cross-sectional view along X－X' >

VISION GUIDE WITH LIGHT GUIDING ROD AND GUARD CABLE USING SAME

TECHNICAL FIELD

The present invention relates to improvement on a vision guide, in detail, pertaining to a vision guide which allows the vision guiding to be realized with wound around the rope member and light emitted linearly and whose light emitting performance is hard to deteriorate even for outside use over the long period of time and is hard to entail the slackening thereof after the winding and a guard cable using the same.

BACKGROUND ART

As well-known, it often happens that protection barriers (so-called guard cables) in which the wire ropes are laid over the poles are installed along the sides of the roads or the alienated zones secured at the centers of the roads on the highways or expressways. However, since the drivers are hard to see the wire ropes between the poles in darkness, there is likelihood that they might overlook such ropes so as to cause accidental contacts with them during the driving.

Thus, in the prior art, such technique is known (refer to the disclosure of Patent Literature 1) as the fluorescent linear bodies being spirally wound along the indentations formed between the strands of the wire ropes in terms of the guard cables, but this prior art is faced with the problem with which it is hard to provide the guard cables with satisfactory vision guiding effect due to the limit in amount of emitted light of such linear bodies.

On the other hand, in the prior art, such technique is known (refer to the disclosure of Patent Literature 2) as the fluorescent strands being adopted for the wire ropes themselves in terms of the guard cables, but this prior art is not only faced with the same problem as mentioned above with the amount of emitted light, but also takes a lot of labor and cost when such technique is applied to the existing guard cables just because the whole wire ropes must be replaced with such strands.

In this regard, to solve the problem with the amount of emitted light as mentioned above, such a method may be thought up as laying between the poles along the wire ropes another type of rope (such as LED illumination rope) with which the blinking lamps are provided with a prescribed interval therebetween, in which method electrically energized and laid-over light sources themselves must be exposed to the external surroundings so that such light sources become vulnerable to malfunction due to e.g. such natural phenomena as wind and rain or physical deterioration.

Further, in the prior art, such self-light emitting vision guide (delineator) of LED type is also known as being disposed with a prescribed interval therebetween on the tops of the poles, but this type of vision guide is of intermittently blinking light emission type so as to cause front lit induced glare (glittering) on the part of the drivers at wheel, so that it fails to bring satisfactory vision guiding effect and safety, which leaves something to be desired in practice.

PRIOR ART

Citation

Patent Literature 1: Granted Japanese Utility Model Publication No. 1979 (SHOWA54)-41049

Patent Literature 2: Japanese Utility Model Application Publication No. 1985 (SHOWA60)-40519

SUMMARY OF INVENTION

Technical Problem

In view of the foregoing, the present invention is to provide a vision guide with a light guiding rod which allows the vision guiding to be realized with wound around the rope member and light emitted linearly during the night or in darkness and whose light emission performance is hard to deteriorate even for external use over the long period of time and which facilitates installation work and is hard to invite the slackening thereof after the winding, and a guard cable using the same.

Solution to Problem

The means adopted by the inventors to solve the above issues are explained below with reference to the accompanying drawings.

The present invention is characterized in that the vision guide with a light guiding rod 1 comprises a rope member 3 formed by twisting plural strands S and used outdoors; the light guiding rod 1 of circumferentially light emitting type which is adheringly wound around spiral indentations V formed between the strands S and S on the outer circumference of the rope member 3 and is provided with a core layer 11 essentially made of an acrylic-based resin and a clad layer 12 essentially made of a fluorine-based resin; and a light source 2 attached to an end portion of the light guiding rod 1, in which amount of change in luminance of the light guiding rod 1 in test time over the duration of 1000 hours by an accelerated weathering tester is contained within the range of ±10%; amount of change in each numerical value of chromaticity [x, y] thereof is contained within the range of ±0.02; flexural modulus of elasticity of the light guiding rod 1 under the atmosphere of −20 degrees Centigrade is contained within the range of 0.5 to $5.0\times10^3$ MPa; the rope member 3 is formed by twisting the strands S at a twisting angle from 10° to 20°; and the spiral indentations V are uniformly formed with a pitch from 100 mm to 200 mm.

As for the light guiding rod 1, it is preferred that what an acrylic-based elastomer is mixed with an acrylic-based hard resin be adopted for the material of the core layer 11 in order to meet requirements on both flexural modulus of elasticity and light guiding performance and the mixing ratio of the latter to the former be 95:5 to 70:30.

As for the light guiding rod 1, it is also preferred that 0.01 to 5 parts by weight of titanium oxide having ultraviolet rays absorbing action as a light scattering agent be added to 100 parts by weight of the fluorine-based resin of which the clad layer 12 is made in order to secure satisfactory weather resistance.

It is also preferred that the light guiding rod 1 be such that the luminance of emitted light from it at the portion 4 m away from the light source 2 is 3 cd/$m^2$ or higher upon light from the light source 2 whose driving current, luminous intensity and directivity are 30 mA, 20000 mcd and 20° respectively being made incident onto the end portion of the light guiding rod 1 wound around the rope member 3.

The vision guide with the light guiding rod permits a guard cable G (in the present specification, including not only those installed on the sides of the roads, but also those installed on the alienated zones secured at the center of the roads) to be arranged together with the plural poles 5 installed with a prescribed interval therebetween on the roads, in which case the rope members 3 are laid over between the poles 5 and the light sources 2 are attached to the poles 5 with mounted to the end portions of the light guiding rods 1 of circumferentially light emitting type.

Advantageous Effect

The vision guide with a light guiding rod according to the present invention allows the light guiding rod not only to linearly emit light by light being made incident onto the rod from the light source, but also its light emission performance to keep for a long time even when it is used with wound around the rope member (such as guard cables and mooring ropes for vessels) for outdoor use, just because the light guiding rod is of circumferentially light emission type excellent in weather resistance.

Additionally, the use of the light guiding rod having optimum flexural modulus of elasticity permits the rod to be smoothly wound around the rope member without doing damage thereon and to keep adhered on the rope member because it is hard to be slackened after the winding. On top of that, by choosing the color of light emitted from the light guiding rod and adjusting the amount of emitted light according to the light source, it successfully leads to realizing effective vision guidance.

In view of the foregoing, the present invention can provide a vision guide with a light guiding rod which is not only excel lent in vision guidance during the night or in darkness, but also advantageous in the aspects of installation readiness and weather resistance for outdoor use, so that its industrial applicability is considered very high.

BEST MODE FOR CARRYING OUT THE INVENTION

First Embodiment

Figure 1:
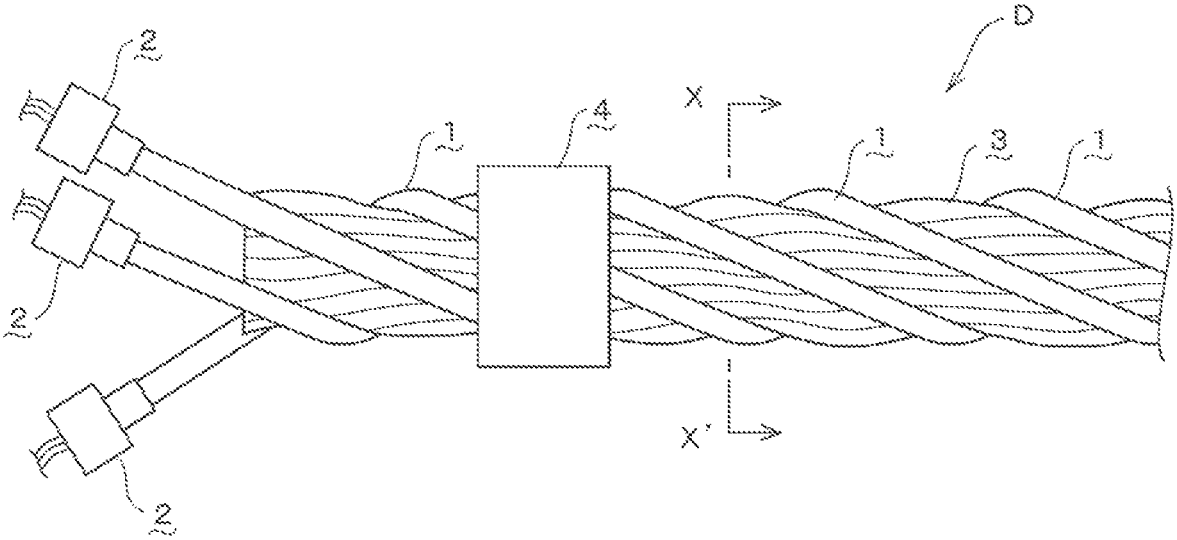
FIG. 1 illustrates a side view and a cross-sectional view of the vision guide with a light guiding rod according to the first embodiment of the present invention.
Figure 1:
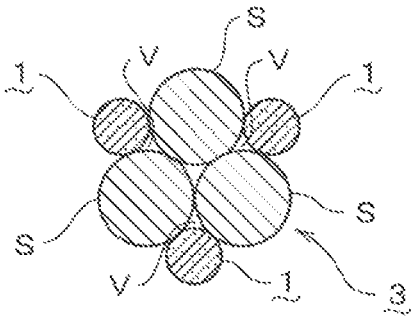

The first embodiment hereof is explained with reference to FIGS. 1 and 2. To note, in the drawings, what is referred to as reference sign 1 is a light guiding rod of circumferentially light emitting type and what is referred to as reference sign 2 is a light source. It is a rope member that is referred to as reference sign 3 and it is a vision guide with a light guiding rod that is referred to as reference sign D.

[Constitution of Vision Guide with Light Guiding Rod]

[1] On Basic Structure of Vision Guide with Light Guiding Rod

Figure 2:
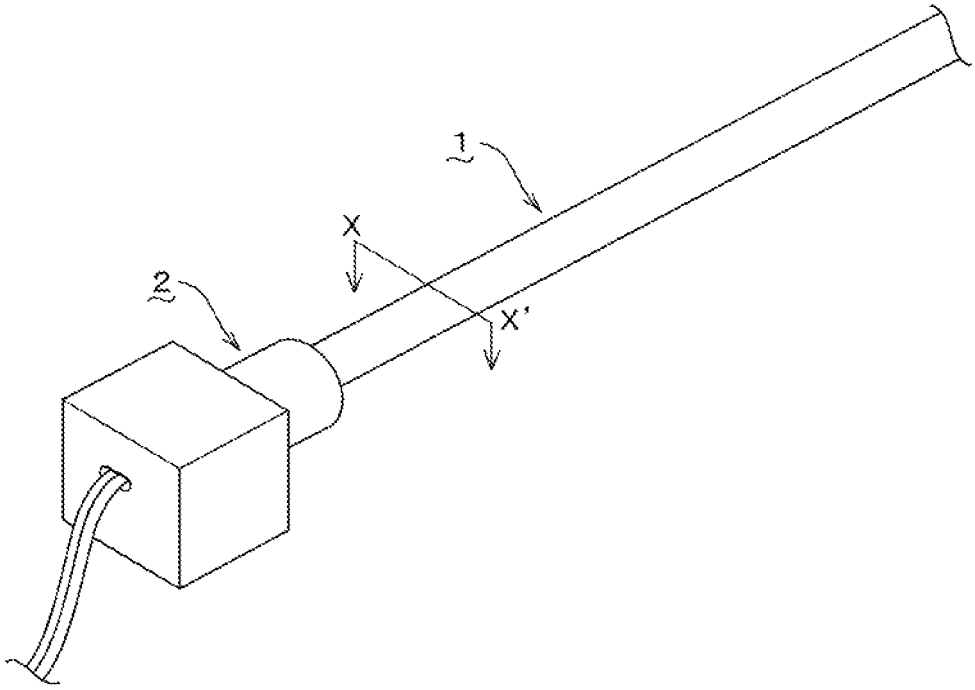
FIG. 2 illustrates a perspective view of the light guiding rod and the light source along with a cross-sectional view of the former according to the first embodiment of the present invention.
Figure 2:
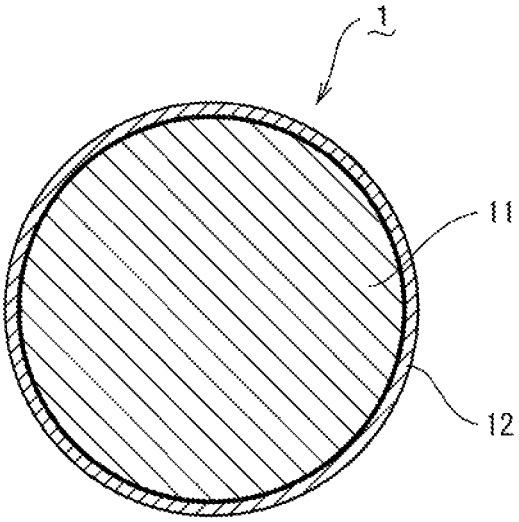

According to the present embodiment, as illustrated in FIGS. 1(*a*) and (*b*) as well as FIGS. 2(*a*) and (*b*), the vision guide with a light guiding rod D is constituted by the light source 2 being mounted to the end portion of the light guiding rod 1 of circumferentially light emitting type and the light guiding rod 1 being fixedly wound around the rope member 3 formed by twisting plural strands S. In this context, the light guiding rod 1 is adheringly wound around spiral indentations V formed between the strands S on the outer circumference of the rope member 3. As for the light guiding rod 1, as illustrated in FIGS. 2(*a*) and (*b*), it is arranged with a clad layer 12 formed on the outer circumference of a core layer 11 at the center and the core layer 11 is essentially made of an acrylic-based resin while the clad layer 12 is essentially made of a fluorine-based resin. In this regard, the light guiding rod 1 is arranged such that amount of change in luminosity thereof in test time over the duration of 1000 hours by an accelerated weathering tester is contained within the range of ±10% and amount of change in each numerical value of chromaticity [x, y] thereof is contained within the range of ±0.02 and also as to the bending performance as a whole, the flexural modulus of elasticity of the light guiding rod under the atmosphere of −20 degrees Centigrade ranges from 0.5 to $5.0\times10^3$ MPa.

What is formed by twisting the strands S at the twisting angle ranging from 10° to 20° and by the spiral indentations V being uniformly provided with a pitch ranging from 100 mm to 200 mm is adopted for the rope member 3, thereby, successfully preventing the light guiding rod 1 wound around the rope member 3 and having the prescribed flexural modulus of elasticity from being slackened and suspended downwards. In this relation, even when the vision guide D is used outdoors, the light guiding rod 1 is so excellent in weather resistance that such problem as its light emission performance deteriorating for a short period of time does not arise.

[2] On Light Guiding Rod

[2-1] Material for Core Layer

Then, explanation is given on each component of the vision guide D with a light guiding rod. As for the light guiding rod 1, what an acrylic-based hard resin is mixed with an acrylic-based elastomer is adopted for the material for the core layer 11, thereby, successfully leading to not only making the light guiding rod 1 emit light more uniformly, but also providing the rod with optimal flexibility with which it can be readily wound around the rope member 3 and is hard to be slackened. In this regard, it is preferred that the mixing ratio of the acrylic-based hard resin to the acrylic-based elastomer be from 95:5 to 70:30.

One or the plurality of poly (methyl methacrylate), poly (ethyl methacrylate), poly (isobutyl methacrylate) and poly (n-butyl methacrylate) can be favorably adopted for the acrylic-based hard resin from which the core layer 11 is partly made. To note, in the present specification, the acrylic-based resins whose glass transition temperature (Tg) is at room temperature (25 degrees Centigrade) or higher are referred to as 'acrylic-based hard resins'.

One or both of a block copolymer (MMA-BA Block Copolymer) of methyl methacrylate and butyl acrylate and a block copolymer of methyl acrylate and butyl acrylate which are thermoplastic elastomers can be favorably adopted for the acrylic-based elastomer from which the core layer 11 is partly made.

[2-2] On Shape of Core Layer

Figure 3:
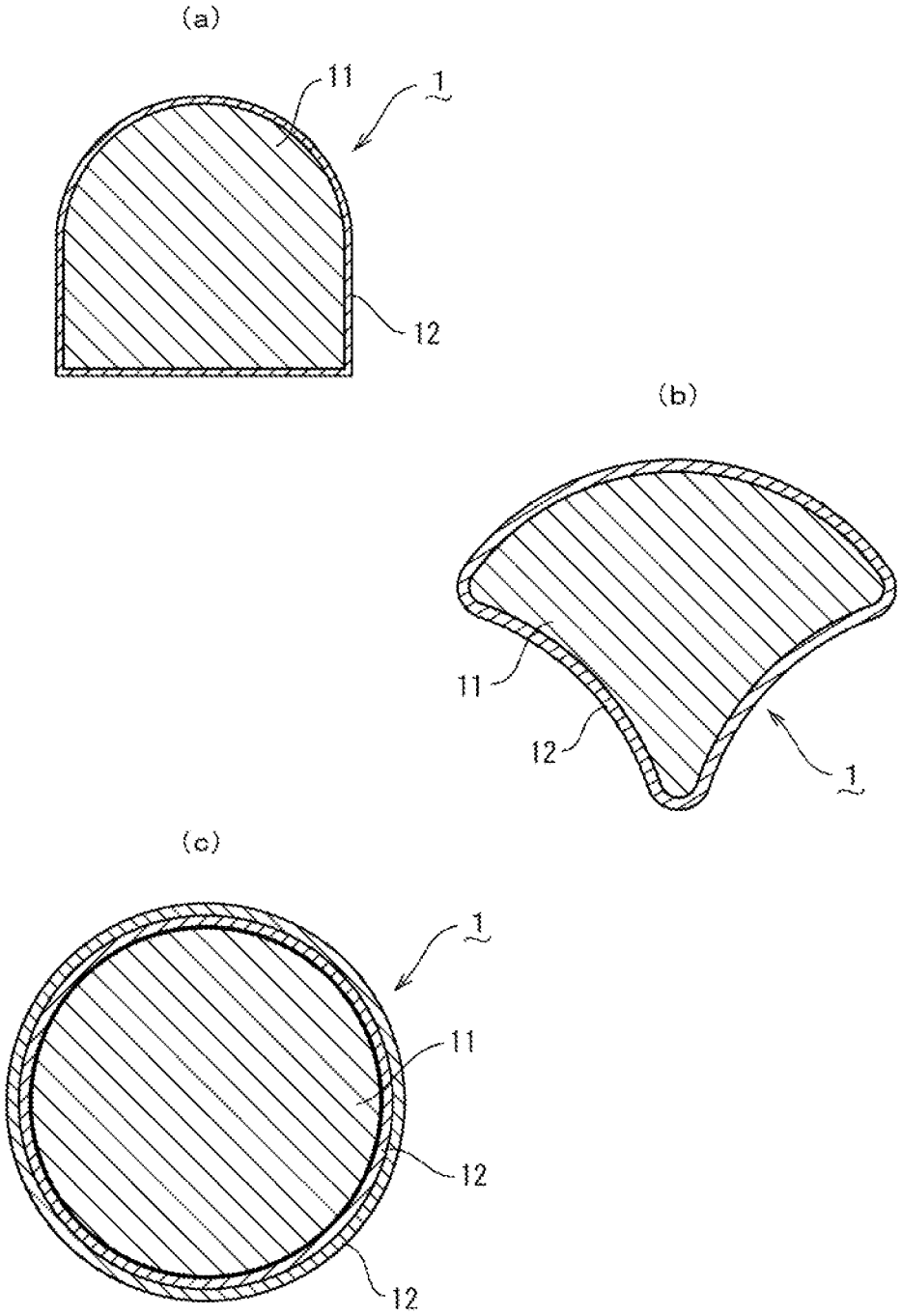
FIG. 3 illustrates modified cross-sectional views of the light guiding rod according to the present invention.

As for the shape of the core layer 11, according to the present embodiment, as illustrated in FIG. 1, it is represented with a circular shape in cross section, but the cross-sectional shape of the core layer 11 may be semi-oval like a Japanese fish paste steamed cake (or 'kamaboko' in Japanese) or it may take such cross-sectional shapes as to be mounted into the indentations V of the rope member 3, as illustrated in FIGS. 3(*a*) and (*b*), besides which such cross-sectional shapes as being oval, semi-circular or polygonal are also adoptable.

[2-3] on Material for Clad Layer

One or the plurality of a copolymer (ETFE) of ethylene and tetrafluoroethylene, a copolymer (EFEP) of hexafluoropropylene, tetrafluoroethylene and ethylene and poly vinylidene difluoride which are fluorine-based resins can be favorably adopted for the main material for the clad layer 12 of the light guiding rod 1. In this way, by adopting a fluorine-based resin whose friction coefficient is smaller for the main material for the clad layer 12, it permits the rod to be wound around the rope member 3 without a hitch.

[2-4] on Shape of Clad Layer

As to the shape of the clad layer 12, it suffices that it is formed on the outer circumference of the core layer 11 with a prescribed thickness, in which it may be composed of one layer according to the present embodiment or of multilayered configuration as illustrated in FIG. 3(*c*). In this regard, it is preferred that the thickness of the clad layer 12 range from 0.1 mm to 1.0 mm.

[2-5] On Light Scattering Agent

According to the present embodiment, the weather resistance of the light guiding rod is enhanced by a light scattering agent having ultraviolet rays absorbing action being added to the material for the clad layer 12. Specifically speaking, in the present embodiment, 0.01 to 5 parts by weight of powdery titanium oxide as the light scattering agent is added to 100 parts by weight of the main material for the clad layer 12. To note, as the light scattering agent, barium sulfate and the like can be used as well besides titanium oxide. Further, the light scattering agent can be added not only to the clad layer 12, but also to the core layer 11.

[2-6] On Weather Resistance of Light Guiding Rod

As to the weather resistance of the light guiding rod 1, it is preferred that amount of change in luminosity thereof in test time over the duration of 1000 hours by an accelerated weathering tester (sunshine weather meter) be contained within the range of ±10% (preferably, within the range of ±5%) and amount of change in each numerical value of chromaticity [x, y] thereof be contained within the range of ±0.02 (preferably, within the range of ±0.01). The accelerated weathering test of the light guiding rod 1 carried out under the condition that the rod is wound around the steel wire rope proves to be effective to contain such amount of change within the above ranges, which means that there is no case where the amount of emitted light conspicuously deteriorates or change in emitted light color arises even when the light guiding rod is subjected to outdoor use for a long period of time.

[2-7] On Flexural Modulus of Elasticity of Light Guiding Rod

As for the flexural modulus of elasticity of the light guiding rod 1, it is preferred that such flexural modulus under the atmosphere of −20 degrees Centigrade range from 0.5 to $5.0\times10^3$ MPa (preferably, from 2.0 to $4.0\times10^3$ MPa), thereby, permitting the rod 1 to be smoothly wound around the rope member 3 even in cold or frigid climate zones while making the rod 1 hard to be slackened after the winding. When such flexural modulus is too large, it results in making it hard to twistingly wind the rod 1 around the rope member 3 while forcing the rod to be wound around the rope member leads to the rod breaking beyond its elastic limit. On the other hand, when such flexural modulus is too small, the rod 1 becomes easy to be slackened after the winding.

[2-8] On Light Emission Performance of Light Guiding Rod

In the present embodiment, such light guiding rod 1 is used as the luminance of emitted light from it at the portion 4 m away from the light source 2 is 3 cd/m$^2$ or higher upon light from the light source 2 whose driving current, luminous intensity and directivity are 30 mA, 20000 mcd and 20° respectively being made incident onto the end portion of the light guiding rod 1 wound around the rope member 3.

[3] On Light Source

As for the light source, according to the present embodiment, the LED light source of a single color is used, but not only single-color light emission types, but also several colors light emission types may well be used according to practical applications. Further, the light source 2 may well be attached not only at one end of the light guiding rod 1, but also at both ends thereof and include LD light sources, SLD ones, Halogen lamps and the like besides the LED ones. The power source to which the light source 2 is connected may well be AC ones or DC ones, in which solar batteries are also adoptable for outdoor use.

[4] On Rope Member

As for the rope member 3 around which the light guiding rod 1 is wound, according to the present embodiment, a wire rope made from metal is used, but it may well be favorably made from carbon fibers, aramid fibers or what such materials are combined for practical use. Additionally, a string or cord made from natural fibers or synthetic resin fibers may well be adopted for the rope member 3 besides the wire rope.

In the present embodiment, although the wire rope which is formed with three strands S, S and S, each of which is composed of bundled metallic wires, twisted together and which has 18 mm in diameter (preferably, having 5 mm to 50 mm) as illustrated in FIGS. 1(*a*) and (*b*) is adopted for the above-mentioned rope member 3, the thickness of the strand S, the number of the strands S and the number by which the strands are twisted together can be arbitrarily altered. To note, according to the thickness of the strand S, the number of the strands and the number by which the strands are twisted together, the number, depth, width and spiral pitch of the formed indentations V each change, so that it is required to make the number, thickness and flexibility of the light guiding rods 1 each in use correspond to the rope member 3 in use.

[5] On Fixing Means for Light Guiding Rod

In the present embodiment, the light guiding rods 1 are fixed with respect to the rope member 3 by ring-shaped fixing tools 4, but they may well be fixed with respect thereto by be fixing tools 4 being wound around the rope member 3 through the light guiding rods 1. In this regard, other than the fixing tools 4, such means as adhesives may well be adopted for the fixing means for the light guiding rods 1.

[6] On Applications

As for the applications of the vision guide for the rope member, such guide can be advantageously applied to such rope members used outdoors as the ropes for the guard cables (described in detail later), those for mooring boats, those for scaffolding used in construction sites and the like, those for illumination purpose and those for preventing nuisance animals from invasion used in the agricultural field.

Second Embodiment (Constitution of Guard Cable)

[1] Basic Structure of Guard Cable

Figure 4:
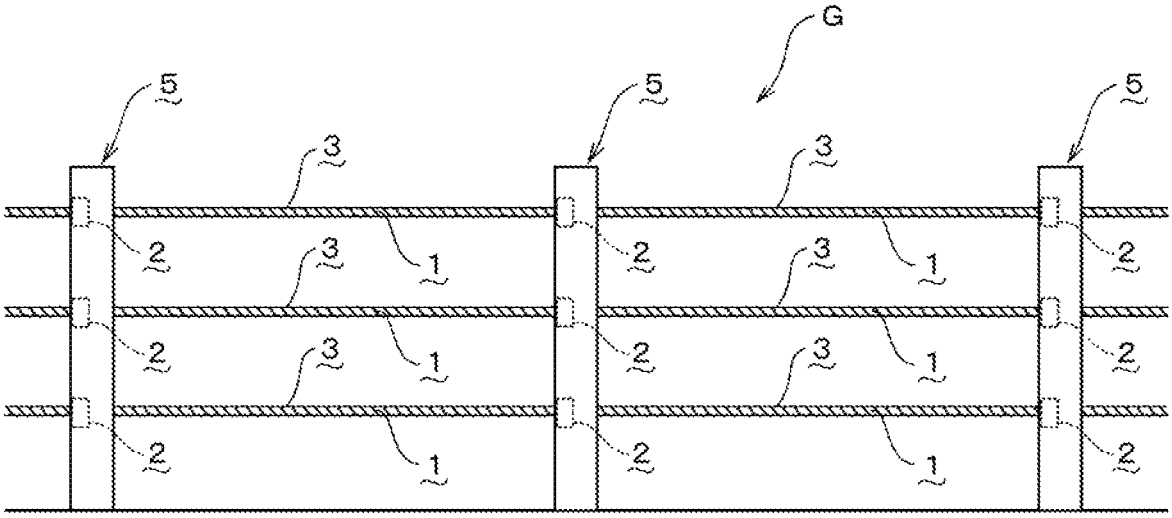
FIG. 4 illustrates a frontal view of the poles according to the second embodiment of the present invention.
Figure 5:
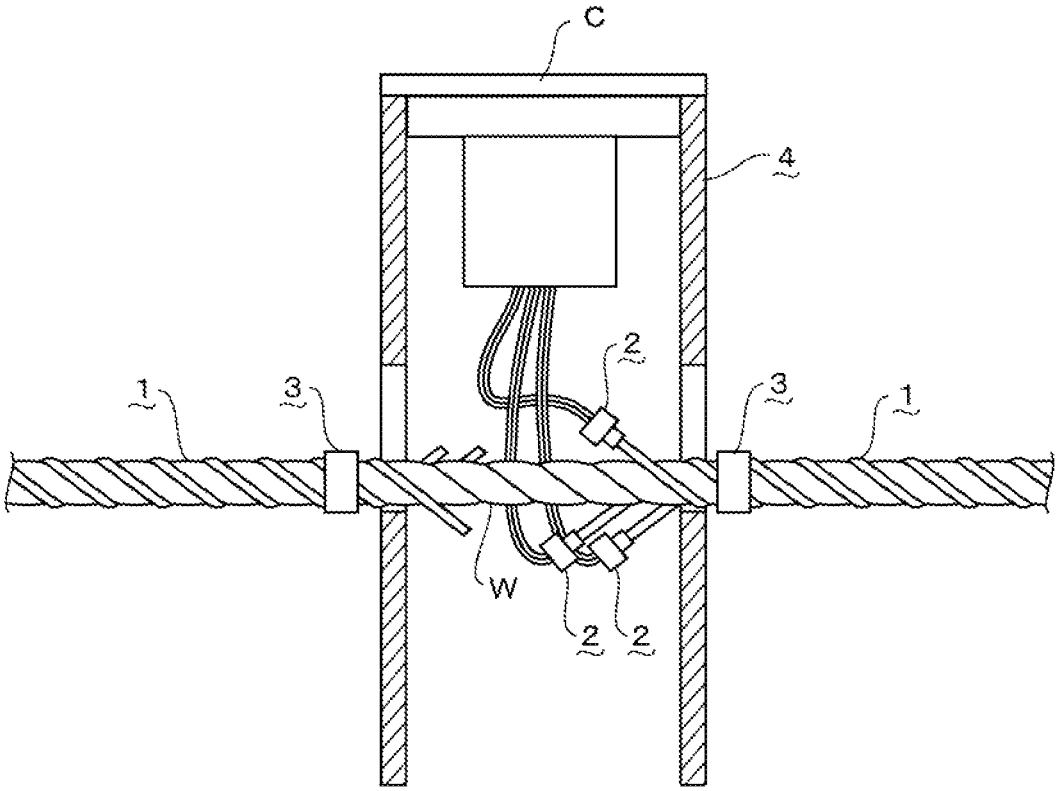
FIG. 5 is an explanatory view illustrating the mounting structure of the light source according to the second embodiment of the present invention.

Then, the second embodiment of the present invention is explained based on the illustrations of FIGS. 4 and 5. According to the present embodiment, as illustrated in FIG. 4, the rope members 3 are laid between the plural poles 5 disposed on the road with the predetermined interval between them; the light guiding rod is spirally wound around the respective rope members 3; and the light source 2 attached to the end portion of the light guiding rod 1 respectively is attached to the pole 5, thereby, the guard cable G being constituted.

Then, actuating the light sources 2 leads to light made incident from such sources passing through the light guiding rods 1 so as to make the outer circumferences of such rods emit light, so that the outer peripheries of the rope members 3 seem to spirally emit light. In this regard, utilizing the spiral indentations V of the rope members 3 facilitates the light guiding rods 1 to be wound around the ropes and fixed with respect thereto.

[2] On Poles

As for the poles 5, according to the present embodiment, the cylindrical bodies which are made from metal and disposed with their base portions embedded into the road are used, but the bodies having a shape provided with a foundation portion that are used by being placed indoors are also adoptable for such poles. In this relation, the shape of the pole 5 is not limited to the cylindrical one, but prism-shaped types and what plural cylindrical-shaped types and prism-shaped types are integrally joined together are also adoptable for such poles.

[3] Structure of Attaching Light Source

As for the structure of attaching the light source 2 to the pole 5, according to the present embodiment, as illustrated in FIG. 5, the light source 2 is connected to the battery fixed on the cover member C of the pole 5 in the state where the rope member 3 is inserted through the pole 5. To note, such structures as the battery corresponding to the DC power source being fixed onto the inner wall of the pole 5 or introducing the AC power source into the pole 5 are also adoptable. In this connection, the light source 2 can be attached to the outer side of the pole 5 along with a housing as well.

EXAMPLES (Verification Test for Advantageous Effects)

Then, explanation is given on the verification test for the advantageous effects brought by the present invention. To begin with, according to the present test, plural samples (First to Sixth Examples below), the materials of which cores of the light guiding rods are different from one another, are prepared and weather resistance and flexural modulus of elasticity are evaluated for each sample. Hereafter, the production condition of each sample according to the first to sixth examples and the respective test methods and their results are explained.

First Example

In this example, a light guiding rod of circumferentially light emission type whose cross-sectional shape is circular and whose diameter is 3.5 mm (the diameter of the core layer being 3.1 mm and the thickness of the clad layer being 0.2 mm) has been produced through co-extrusion molding. Poly (methyl methacrylate) which is an acrylic-based hard resin is adopted for the main material of the core layer while ETFE which is a fluorine-based resin is adopted for the main material of the clad layer. 0.065 parts by weight of titanium oxide which is a light scattering agent is added to 100 parts by weight of the main material from which the clad layer is made.

Second Example

In this example, in the similar way as the first example, a light guiding rod of circumferentially light emission type whose cross-sectional shape is round bar-shaped and whose diameter is 3.5 mm (the diameter of the core layer being 3.1 mm and the thickness of the clad layer being 0.2 mm) has been produced through co-extrusion molding. What poly (methyl methacrylate) which is an acrylic-based hard resin is mixed with MMA-BA block copolymer which is an acrylic-based elastomer, the proportional ratio in weight of the former to the latter being 95:5, is adopted for the main material of the core layer while ETFE which is a fluorine-based resin is adopted for the main material of the clad layer. 0.065 parts by weight of titanium oxide which is a light scattering agent is added to 100 parts by weight of the main material from which the clad layer is made.

Third Example

In this example, in the similar way as the first example, a light guiding rod of circumferentially light emission type whose cross-sectional shape is round bar-shaped and whose diameter is 3.5 mm (the diameter of the core layer being 3.1 mm and the thickness of the clad layer being 0.2 mm) has been produced through co-extrusion molding. What poly (methyl methacrylate) which is an acrylic-based hard resin is mixed with MMA-BA block copolymer which is an acrylic-based elastomer, the proportional ratio in weight of the former to the latter being 90:10, is adopted for the main material of the core layer while ETFE which is a fluorine-based resin is adopted for the main material of the clad layer. 0.065 parts by weight of titanium oxide which is a light scattering agent is added to 100 parts by weight of the main material from which the clad layer is made.

Fourth Example

In this example, in the similar way as the first example, a light guiding rod of circumferentially light emission type whose cross-sectional shape is round bar-shaped and whose diameter is 3.5 mm (the diameter of the core layer being 3.1 mm and the thickness of the clad layer being 0.2 mm) has been produced through co-extrusion molding. What poly (methyl methacrylate) which is an acrylic-based hard resin is mixed with MMA-BA block copolymer which is an acrylic-based elastomer, the proportional ratio in weight of the former to the latter being 80:20, is adopted for the main material of the core layer while ETFE which is a fluorine-based resin is adopted for the main material of the clad layer. 0.065 parts by weight of titanium oxide which is a light scattering agent is added to 100 parts by weight of the main material from which the clad layer is made.

Fifth Example

In this example, in the similar way as the first example, a light guiding rod of circumferentially light emission type whose cross-sectional shape is round bar-shaped and whose diameter is 3.5 mm (the diameter of the core layer being 3.1 mm and the thickness of the clad layer being 0.2 mm) has been produced through co-extrusion molding. What poly (methyl methacrylate) which is an acrylic-based hard resin is mixed with MMA-BA block copolymer which is an acrylic-based elastomer, the proportional ratio in weight of the former to the latter being 70:30, is adopted for the main material of the core layer while ETFE which is a fluorine-based resin is adopted for the main material of the clad layer. 0.065 parts by weight of titanium oxide which is a light scattering agent is added to 100 parts by weight of the main material from which the clad layer is made.

Sixth Example

In this example, in the similar way as the first example, a light guiding rod of circumferentially light emission type whose cross-sectional shape is round bar-shaped and whose diameter is 3.5 mm (the diameter of the core layer being 3.1 mm and the thickness of the clad layer being 0.2 mm) has been produced through co-extrusion molding. MMA-BA block copolymer which is an acrylic-based elastomer is adopted for the main material of the core layer while ETFE which is a fluorine-based resin is adopted for the main material of the clad layer. 0.065 parts by weight of titanium oxide which is a light scattering agent is added to 100 parts by weight of the main material from which the clad layer is made.

(Evaluation of Weather Resistance)

Weather resistance test has been performed for each sample having 300 mm in length according to the first to sixth examples by use of an accelerated weathering tester (sunshine weather meter) under the following conditions: the duration of 1000 hours in test time and the black panel temperature of 63 degrees Centigrade). Then, upon checking the chromaticity of emitted light color before and after the test and amount of change in chromaticity of emitted light color before and after the test for each sample, as illustrated in the following tables 1 to 3, it has been confirmed that amount of change in luminosity of the light guiding rod in test time over the duration of 1000 hours is contained within the range of ±10% and amount of change in each numerical value of chromaticity [x, y] thereof is contained within the range of ±0.02. As for each sample according to the first to fourth examples, it has been confirmed that amount of change in luminosity thereof in test time over the duration of 1000 hours is contained within the range of ±5% and amount of change in each numerical value of chromaticity [x, y] thereof is contained within the range of ±0.01.

TABLE 1

| Before Test Distance | First Example | | | Second Example | | | Third Example | | |
|---|---|---|---|---|---|---|---|---|---|
| (mm) | Lv | x | y | Lv | x | y | Lv | x | y |
| 50 | 287.52 | 0.2968 | 0.3153 | 316.10 | 0.2970 | 0.3150 | 405.09 | 0.2993 | 0.3136 |
| 100 | 259.79 | 0.2967 | 0.3149 | 275.90 | 0.2969 | 0.3146 | 341.32 | 0.2993 | 0.3132 |
| 150 | 243.57 | 0.2962 | 0.3138 | 252.38 | 0.2964 | 0.3135 | 304.02 | 0.2991 | 0.3123 |
| 200 | 232.07 | 0.2957 | 0.3136 | 235.70 | 0.2959 | 0.3133 | 277.55 | 0.2987 | 0.3121 |
| 250 | 223.14 | 0.2983 | 0.3164 | 222.76 | 0.2985 | 0.3161 | 257.03 | 0.3009 | 0.3142 |
| Distance | Fourth Example | | | Fifth Example | | | Sixth Example | | |
| (mm) | Lv | x | y | Lv | x | y | Lv | x | y |
| 50 | 537.82 | 0.3012 | 0.3124 | 564.52 | 0.3028 | 0.3115 | 693.28 | 0.3088 | 0.3079 |
| 100 | 452.56 | 0.3013 | 0.3121 | 473.72 | 0.3028 | 0.3112 | 565.04 | 0.3091 | 0.3075 |
| 150 | 402.69 | 0.3013 | 0.3114 | 420.61 | 0.3031 | 0.3107 | 490.03 | 0.3101 | 0.3077 |
| 200 | 367.31 | 0.3010 | 0.3111 | 382.92 | 0.3028 | 0.3102 | 436.81 | 0.3100 | 0.3070 |
| 250 | 339.86 | 0.3029 | 0.3128 | 353.69 | 0.3044 | 0.3116 | 395.53 | 0.3106 | 0.3069 |

LV: Luminosity,
[x, y]: Chromaticity

TABLE 2

| 1000 hours Distance | First Example | | | Second Example | | | Third Example | | |
|---|---|---|---|---|---|---|---|---|---|
| (mm) | Lv | x | y | Lv | x | y | Lv | x | y |
| 50 | 287.81 | 0.2999 | 0.3201 | 316.73 | 0.3014 | 0.3208 | 409.96 | 0.3037 | 0.3193 |
| 100 | 259.27 | 0.3008 | 0.3196 | 277.0 | 0.3021 | 0.3214 | 353.61 | 0.3042 | 0.3192 |
| 150 | 241.38 | 0.3006 | 0.3195 | 259.20 | 0.3016 | 0.3200 | 309.19 | 0.3048 | 0.3187 |
| 200 | 234.85 | 0.3007 | 0.3198 | 234.99 | 0.3016 | 0.3206 | 278.39 | 0.3042 | 0.3194 |
| 250 | 220.91 | 0.3037 | 0.3231 | 229.44 | 0.3042 | 0.3233 | 266.02 | 0.3079 | 0.3215 |
| Distance | Fourth Example | | | Fifth Example | | | Sixth Example | | |
| (mm) | Lv | x | y | Lv | x | y | Lv | x | y |
| 50 | 560.41 | 0.3069 | 0.3187 | 591.06 | 0.3100 | 0.3205 | 773.00 | 0.3164 | 0.3160 |
| 100 | 458.45 | 0.3075 | 0.3191 | 504.51 | 0.3113 | 0.3211 | 628.33 | 0.3173 | 0.3184 |

TABLE 2-continued

| | | | | | | | | | |
|---|---|---|---|---|---|---|---|---|---|
| 150 | 411.15 | 0.3074 | 0.3185 | 440.80 | 0.3122 | 0.3208 | 548.35 | 0.3211 | 0.3210 |
| 200 | 376.86 | 0.3083 | 0.3186 | 395.94 | 0.3135 | 0.3215 | 477.87 | 0.3230 | 0.3230 |
| 250 | 345.30 | 0.3108 | 0.3217 | 373.85 | 0.3154 | 0.3237 | 431.13 | 0.3281 | 0.3276 |

TABLE 3

| Amount in Change Distance | First Example | | | Second Example | | | Third Example | | |
|---|---|---|---|---|---|---|---|---|---|
| (mm) | Lv | x | y | Lv | x | y | Lv | x | y |
| 50 | 0% | 0.0031 | 0.0048 | 0% | 0.0045 | 0.0058 | 1% | 0.0044 | 0.0057 |
| 100 | 0% | 0.0041 | 0.0047 | 0% | 0.0053 | 0.0067 | 4% | 0.0049 | 0.0060 |
| 150 | −1% | 0.0044 | 0.0057 | 3% | 0.0052 | 0.0065 | 2% | 0.0057 | 0.0064 |
| 200 | 1% | 0.0050 | 0.0062 | 0% | 0.0058 | 0.0073 | 0% | 0.0055 | 0.0073 |
| 250 | −1% | 0.0054 | 0.0067 | 3% | 0.0057 | 0.0073 | 4% | 0.0070 | 0.0073 |
| Distance | Fourth Example | | | Fifth Example | | | Sixth Example | | |
| (mm) | Lv | x | y | Lv | x | y | Lv | x | y |
| 50 | 4% | 0.0057 | 0.0063 | 5% | 0.0072 | 0.0090 | 12% | 0.0076 | 0.0081 |
| 100 | 1% | 0.0062 | 0.0070 | 7% | 0.0085 | 0.0099 | 11% | 0.0082 | 0.0109 |
| 150 | 2% | 0.0061 | 0.0071 | 5% | 0.0091 | 0.0101 | 12% | 0.0110 | 0.0133 |
| 200 | 3% | 0.0073 | 0.0075 | 3% | 0.0107 | 0.0113 | 9% | 0.0130 | 0.0160 |
| 250 | 2% | 0.0079 | 0.0089 | 6% | 0.0110 | 0.0121 | 9% | 0.0175 | 0.0207 |

(Evaluation of Flexural Modulus of Elasticity and Flexural Stress)

In compliance with the bending test method of a laminated rod at 5.17.3 of Testing methods for Thermosetting Plastics according to JIS K 6911, such test has been performed for each sample according to the first to sixth examples under the temperature of 23 degrees Centigrade and the atmosphere of −20 degrees Centigrade, as the result of which, it has been confirmed that the flexural modulus of elasticity under the atmosphere of −20 degrees Centigrade of each sample according to the first to sixth examples is contained within the range 0.5 to $5.0\times10^3$ MPa. Further, it has been confirmed that the flexural modulus of elasticity under the atmosphere of −20 degrees Centigrade of each sample according to the first to fifth examples is contained within the range 2.0 to $4.0\times10^3$ MPa.

TABLE 4

| | | First Example | | | | Second Example | | | | Third Example | | | |
|---|---|---|---|---|---|---|---|---|---|---|---|---|---|
| | | 1 | 2 | 3 | Av. | 1 | 2 | 3 | Av. | 1 | 2 | 3 | Av. |
| Flexural Stress (MPa) | 23° C. | 93.45 | 92.14 | 90.82 | 92.14 | 94.51 | 88.75 | 87.88 | 90.38 | 86.61 | 86.79 | 86.61 | 86.67 |
| | −20° C. | 129.94 | 129.97 | 131.88 | 130.60 | 130.86 | 135.74 | 132.79 | 133.13 | 137.16 | 134.66 | 135.91 | 135.91 |
| Flexural Modulus of Elasticity ($\times10^3$ MPa | 23° C. | 2.53 | 2.45 | 2.43 | 2.47 | 2.60 | 2.40 | 2.37 | 2.46 | 2.41 | 2.39 | 2.38 | 2.39 |
| | −20° C. | 3.35 | 3.07 | 3.20 | 3.21 | 3.03 | 3.27 | 3.22 | 3.18 | 3.03 | 3.03 | 3.07 | 3.04 |
| | | Fourth Example | | | | Fifth Example | | | | Sixth Example | | | |
| | | 1 | 2 | 3 | Av. | 1 | 2 | 3 | Av. | 1 | 2 | 3 | Av. |
| Flexural Stress (MPa) | 23° C. | 75.20 | 75.89 | 74.54 | 75.21 | 66.00 | 66.54 | 65.76 | 66.10 | 21.43 | 21.33 | 21.69 | 21.48 |
| | −20° C. | 119.90 | 123.96 | 122.94 | 122.27 | 113.78 | 114.35 | 112.64 | 113.59 | 43.33 | 43.94 | 44.41 | 43.89 |
| Flexural Modulus of Elasticity ($\times10^3$ MPa | 23° C. | 2.10 | 2.13 | 2.05 | 2.09 | 1.88 | 1.91 | 1.88 | 1.89 | 0.66 | 0.66 | 0.66 | 0.66 |
| | −20° C. | 2.45 | 2.62 | 2.67 | 2.58 | 2.40 | 2.50 | 2.38 | 2.43 | 1.02 | 1.03 | 0.99 | 1.01 |

(Evaluation of Light Emission Performance of Light Guiding Rod)

Then, as for the light guiding rod according to the first and second examples respectively, the luminance of emitted light from it at the portion 4 m away from the light source is measured upon light from the light source whose driving current, luminous intensity and directivity are 30 mA, 20000 mcd and 20° respectively being made incident onto the end portion of the light guiding rod wound around the rope member, as the result of which, it has been found that the luminance of emitted light of the sample according to the first example is 5.1 cd/m$^2$ while that of the sample according to the second example is 3.6 cd/m$^2$.

LIST OF REFERENCE SIGNS

1: Light Guiding Rod
11: Core Layer
12: Clad Layer
2: Light Source
3: Rope Member
4: Fixing Tool
5: Pole
D: Vision Guide
S: Strand

The invention claimed is:

1. A vision guide with a light guiding rod comprising:
a rope member formed by twisting plural strands and used outdoors;
a light guiding rod of circumferentially light emitting type which is adheringly wound around spiral indentations formed between the strands on an outer circumference of the rope member, the light guiding rod having a core layer made of an acrylic-based resin and a clad layer provided on an entire outer circumference of the core layer when viewed in cross-section and made of a fluorine-based resin, wherein:
the acrylic-based resin is a mixture of an acrylic-based elastomer with an acrylic-based hard resin with a mixing ratio of the latter to the former being 95:5 to 70:30,
0.01 to 5 parts by weight of titanium oxide having ultraviolet rays absorbing action is added to the fluorine-based resin, and
a thickness of the clad layer is equal to or less than 1.0 mm; and
a light source attached to an end portion of the light guiding rod, wherein:
amount of change in luminance of the guiding rod in test time over duration of 1000 hours by an accelerated weathering tester with a black panel temperature of 63 degrees Centigrade is contained within a range of ±10%;
amount of change in each numerical value of chromaticity [x, y] thereof is contained within a range of ±0.02;
flexural modulus of elasticity of the light guiding rod under the atmosphere of −20 degrees Centigrade is contained within a range of 0.5 to 5.0×10$^3$ MPa;
the rope member is formed by twisting the strands at a twisting angle from 10° to 20°; and
the spiral indentations are uniformly formed with a pitch from 100 mm to 200 mm.

2. The vision guide according to claim 1, wherein the titanium oxide is added as a light scattering agent, and the light scattering agent also includes barium sulfate.

3. The vision guide according to claim 2, wherein luminance of emitted light from the light guiding rod at a portion 4 m away from the light source is 3cd/m$^2$ or higher upon light from the light source whose driving current, luminous intensity and directivity are 30 mA, 20000mcd and 20° respectively being made incident onto an end portion of the light guiding rod wound around the rope member.

4. A guard cable to be arranged together with the vision guide with the light guiding rod according to claim 3 and plural poles installed with a prescribed interval therebetween on roads, wherein:
the rope members are laid over between the poles, and
the light sources are attached to the poles with mounted to the end portions of the light guiding rods of circumferentially light emitting type.

5. The vision guide according to claim 2, wherein the light scattering agent is added to both the clad layer and the core layer.

6. The vision guide according to claim 1, wherein luminance of emitted light from the light guiding rod at a portion 4 m away from the light source is 3cd/m$^2$ or higher upon light from the light source whose driving current, luminous intensity and directivity are 30 mA, 20000mcd and 20° respectively being made incident onto an end portion of the light guiding rod wound around the rope member.

7. A guard cable to be arranged together with the vision guide with the light guiding rod according to claim 6 and plural poles installed with a prescribed interval therebetween on roads, wherein;
the rope members are laid over between the poles, and
the light sources are attached to the poles with mounted to the end portions of the light guiding rods of circumferentially light emitting type.

8. The vision guide according to claim 6, wherein the titanium oxide is added as a light scattering agent, and the light scattering agent also includes barium sulfate.

* * * * *